United States Patent [19]

Schauder et al.

[11] Patent Number: 4,971,178

[45] Date of Patent: Nov. 20, 1990

[54] ELEVATOR SYSTEM WITH INDEPENDENT LIMITING OF A SPEED PATTERN IN TERMINAL ZONES

[75] Inventors: Colin D. Schauder, Murrysville, Pa.; Tac H. Nguyen, Denville, N.J.

[73] Assignee: Inventio AG, Hergiswil, Switzerland

[21] Appl. No.: 305,327

[22] Filed: Feb. 2, 1989

[51] Int. Cl.[5] ..... B66B 1/28

[52] U.S. Cl. ..... 187/117

[58] Field of Search ..... 187/116, 117

[56] References Cited

U.S. PATENT DOCUMENTS

| | | | |
|---|---|---|---|
| 3,379,285 | 4/1968 | Leitz | 187/109 |
| 3,474,886 | 10/1969 | Iordanidis | 187/105 |
| 3,750,850 | 8/1973 | Winkler | 187/129 |
| 3,779,346 | 12/1973 | Winkler | 187/117 |
| 3,814,216 | 6/1974 | Pisatowski | 187/116 X |
| 4,067,416 | 1/1978 | Lowry | 187/105 |
| 4,085,823 | 4/1978 | Caputo et al. | 187/116 |
| 4,128,141 | 12/1978 | Caputo et al. | 187/117 |
| 4,161,235 | 7/1979 | Caputo et al. | 187/116 |
| 4,161,236 | 7/1979 | Husson | 187/117 |
| 4,225,015 | 9/1980 | Yamada | 187/117 |
| 4,238,005 | 12/1980 | Watanabe et al. | 187/109 |
| 4,318,456 | 3/1982 | Lowry | 187/117 |
| 4,356,896 | 1/1982 | Tamura et al. | 187/117 |
| 4,416,352 | 11/1983 | Husson et al. | 187/120 |
| 4,434,874 | 3/1984 | Caputo | 187/116 |
| 4,489,811 | 12/1984 | Yonemoto et al. | 187/117 |
| 4,499,974 | 2/1985 | Nguyen et al. | 187/117 |
| 4,503,939 | 3/1985 | Lawrence et al. | 187/116 |
| 4,691,807 | 9/1987 | Iwata | 187/117 |
| 4,773,509 | 9/1988 | Mine et al. | 187/119 |

*Primary Examiner*—A. D. Pellinen
*Assistant Examiner*—W. E. Duncanson, Jr.
*Attorney, Agent, or Firm*—D. R. Lackey

[57] ABSTRACT

A feedback controlled elevator system driven by a traction drive motor in response to a speed pattern provided by a car controller. The speed pattern is limited when the car approaches a terminal floor within a predetermined terminal slowdown zone adjacent to the terminal floor. A pattern limiting signal is provided in response to digital integration of shaft encoder signals which provides a digital position "x" of the car within a terminal zone. The position "x" of the car is then used to access a read-only-memory which contains the maximum car speed for the specific location of the elevator car. The value from the read-only memory is used to limit the speed pattern.

7 Claims, 4 Drawing Sheets

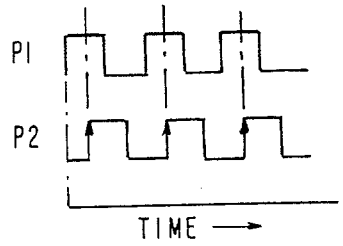
FIG. 3 A
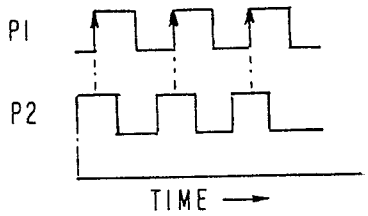
FIG. 3 B
105
| ROM MAP | |
|---|---|
| X | LIMIT |
| S | 0 |
| | |
| | |
| | |
| | |
| | |
| | |
| 0 | CSL |
FIG. 4

ELEVATOR SYSTEM WITH INDEPENDENT LIMITING OF A SPEED PATTERN IN TERMINAL ZONES

TECHNICAL FIELD

The invention relates in general to elevator systems, and more specifically to providing an independent control over terminal slowdown of an elevator car as it approaches a terminal floor of a building.

BACKGROUND ART

An elevator system requires a normal terminal stopping arrangement for an elevator car which is independent of the normal slowdown and stopping arrangement for the car. Thus, if the normal slowdown and stopping arrangement is calling for an operation which will cause the car to approach a terminal floor at an excessive speed, the normal terminal stopping arrangement will automatically override the normal slowdown and stopping arrangement, reducing the speed of the car according to a predetermined deceleration schedule, to stop the car smoothly at the terminal floor. The normal terminal slowdown function will hereinafter be referred to as TSD, for "Terminal Slow Down". Also, some additional emergency terminal device must be used. For example, with reduced stroke buffers, an emergency terminal speed limiting device must be used which is independent of any other emergency related device. This same emergency device, termed ETS for "Emergency Terminal Stop", may be used in elevator systems which have normal stroke buffers. The present invention is related to TSD, not ETS, and is thus related to apparatus for automatically overriding the normal slowdown and stopping control of an elevator car, when the normal slowdown control is malfunctioning, to smoothly stop the car at a terminal floor without exceeding predetermined values of deceleration and/or jerk.

SUMMARY OF THE INVENTION

Briefly, the present invention is a feedback controlled elevator system of the traction type in which the normal slowdown and stopping of an elevator car is controlled by a speed pattern SP. Independent TSD is provided according to the teachings of the invention by establishing a terminal slowdown zone in a hatch which defines the travel path of an elevator car, adjacent to the upper and lower terminal floors of the associated building, such as by mechanical or solid state switches. When the car enters a TSD zone, the associated switch provides a true signal, with a true signal TSDU indicating the car is in the upper TSD zone, and a true signal TSDL indicating the car is in the lower TSD zone. A positional datum using a similar switch is established within each TSD zone, such as 12 inches from the terminal floor, to accommodate those instances when the elevator system is initialized when the car is parked in a TSD zone. When the car passes the positional datum in the upper zone as it travels to the upper terminal floor, the positional datum switch provides a true signal TS12U, and when the car passes the positional datum in the lower zone as it travels to the lower terminal floor, the positional datum switch provides a true signal TS12L.

The position of the elevator car in a TSD zone is determined by digital integration of first and second phase related digital signals P1 and P2 which are provided by a digital shaft encoder on the shaft of a traction drive motor which drives a traction sheave. Motion is imparted to the elevator car and a counterweight, which are interconnected via wire ropes, by reeving the wire ropes about the traction sheave.

First and second binary counters are arranged such that when the car enters a TSD zone, the first counter will count pulses of the first signal P1 when the car is traveling in one direction, and the second counter will count pulses of the second signal P2 when the car is traveling in the opposite direction, i.e., each counter accumulates counts in only one direction of drive motor rotation, and this direction is different for the two counters. The output counts are sampled and subtracted to obtain a binary position value BPV for the motor shaft rotation, and this value is further processed to find the incremental position change IPC since the previous sample was taken.

Signals TSDU and TSDL are sampled and respectively used to latch first and second flip flops when true, which accordingly provide true signals TSU and TSL when latched. According to which latch signal is true, each incremental position change is either added to or subtracted from a car position integral "x". The car position integral "x" is a digital value which represents the distance traveled by the elevator car into a TSD zone, and it is used to address a read-only memory (ROM) which has pre-calculated speed limit values stored therein for each digital value of "x".

The normal speed pattern SP generated by a car controller is applied to a motor control servo via a limiter which selects the lesser of two magnitudes applied to it. One of the magnitudes is the normal speed pattern SP. The remaining input is controlled by an analog switch which selects the output of the speed limit memory when the car is in a TSD zone traveling toward the associated terminal floor, and which otherwise selects the contract speed CSL of the elevator car, i.e., the normal maximum speed of the elevator car.

When the system is initially started with the elevator car parked in a TSD zone, which is likely to happen, the position of the car relative to the position datum controls the start-up procedure. If the car is not between the position datum and the terminal floor, the position integral "x" is jammed to a value which corresponds to the position of the position datum, i.e., 12 inches from the terminal floor, for example. This allows the elevator car to move at a safe speed towards the terminal floor, i.e., the speed limit which would be applied when the car passes the position datum on its way to stopping at the terminal floor; or, car 12 may move away from the floor at any speed up to contract speed CSL. If the car moves towards the terminal floor, "x" will be released when the car reaches the positional datum, and normal operation will then continue from that point. If the car travels in the opposite direction, "x" is set to zero when the car leaves the TSD zone.

If the system is initialized with the car within the TS12 zone, the position integral "x" is jammed to a value which corresponds to a position close to the terminal floor, such as one inch. This allows the car to move towards the terminal floor at a very low speed, or away from the floor at any speed up to CSL. When the car moves out of the TS12 zone, "x" will be set to the 12 inch position, and normal operation will then control the value of "x".

BRIEF DESCRIPTION OF THE DRAWINGS

The invention will become more apparent by reading the following detailed description in conjunction with the drawings, which are shown by way of example only, wherein:

FIGS. 3A and 3B are timing diagrams illustrating the phase relationship between digital shaft encoder signals P1 and P2 for each rotational direction of the shaft of a traction drive motor shown in FIG. 1; and FIG. 4 is a ROM map illustrating a look-up table which outputs speed limits for different input values of car location "x" within a TSD zone.

DESCRIPTION OF PREFERRED EMBODIMENTS

Figure 1:
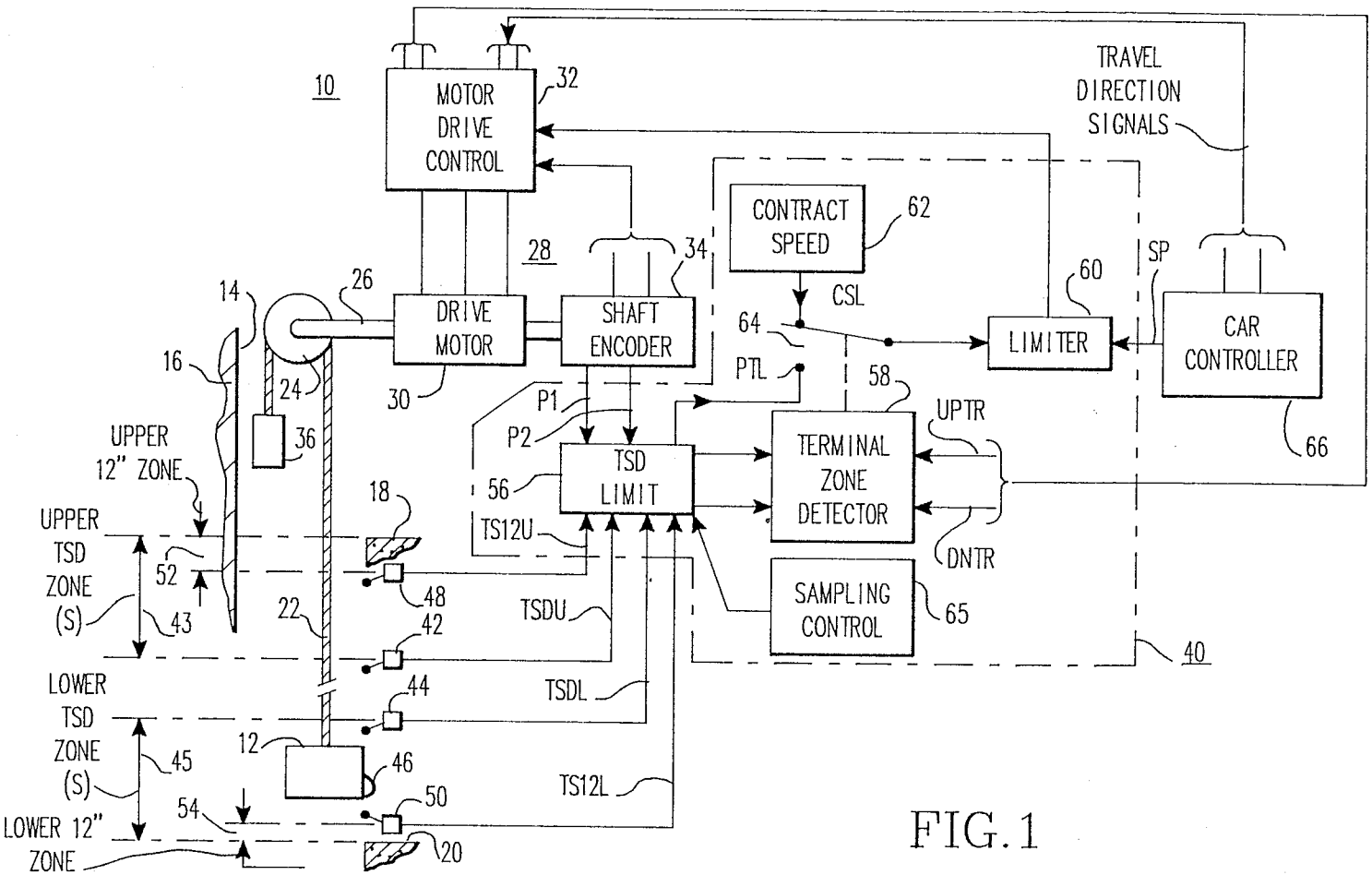
FIG. 1 is a block diagram of an elevator system constructed according to the teachings of the invention.

Referring now to the drawings, and to FIG. 1 in particular, there is shown an elevator system 10 in diagrammatic and block form constructed according to the teachings of the invention. Only a portion of an elevator system necessary to understand the invention is disclosed. For a more complete description of an elevator system, reference may be had to U.S. Pat. Nos. 3,750,850; 4,161,235; and 4,416,352, all of which are assigned to the same assignee as the present application, and which are hereby incorporated into the specification of the present application by reference.

Elevator system 10 includes an elevator car 12 mounted in a hatch or hoistway 14 for guided movement relative to a building 16 having a plurality of floors or landings. Only the upper and lower terminal floors, indicated by reference numerals 18 and 20, respectively, are shown in order to simplify the drawing. Elevator car 10 is supported by a plurality of wire ropes 22 which are reeved over a traction sheave 24 mounted on the shaft 26 of a traction drive machine 28. Drive machine 28 includes a drive motor 30, which may be an AC motor or a DC motor, as desired, drive motor control 32, and a shaft encoder 34. A counterweight 36 is connected to the other ends of ropes 22.

Terminal slowdown apparatus 40 constructed according to the teachings of the invention utilizes six digital input signals. The first two digital input signals are P1 and P2 provided by shaft encoder 34. As shown in the timing diagram of FIG. 3, when shaft 26 turns in one direction, digital signal P1 leads digital signal P2 by 90 degrees, and when shaft 26 turns in the opposite direction, signal P2 leads signal P1 by 90 degrees.

The third and fourth digital input signals are TSDU and TSDL which are indicated in FIG. 1 as being provided by mechanical switches 42 and 44 mounted in hatch 14 which are actuated by a cam 46 carried by elevator car 12. Any other form of switch may be used, such as solid state. Switch 42 is located such that it will be actuated to provide a true signal TSDU as car 12 ascends and enters an upper TSD zone 43. Switch 42 will maintain the true TSDU signal until car 12 descends and leaves the upper TSD zone 43. In like manner, switch 44 is located such that it will be actuated to provide a true signal TSDL as car 12 descends and enters a lower TSD zone 45. Switch 44 will maintain the true TSDL signal until car 12 ascends and leaves the lower TSD zone 45. The length "S" of a TSD zone in feet may be determined from the maximum or contract speed CSL of the elevator car in FPS and the desired rate of deceleration "A" in FPS$^2$ according to the following formula:

$$S = \frac{(CSL)^2}{2A}$$

The remaining two digital signals TS12U and TS12L are provided by hatch mounted switches 48 and 50. Switch 48 is mounted to provide a positional datum in the upper TSD zone 43, and switch 50 is mounted to provide a similar positional datum in the lower TSD zone 45. The positional datum is related to the associated terminal floor, and the distance from the floor is selected such that the desired car speed at that point as car 12 lands at the terminal floor will be a safe initial speed to move the car towards the terminal floor when elevator system 10 is initialized within a TSD zone. For purposes of example, this distance is selected as 12 inches (30.48 cm). Thus, switch 48 establishes an upper 12 inch zone 52 adjacent the upper terminal floor 18, and switch 50 establishes a lower 12 inch zone adjacent the lower terminal floor 54.

Switch 48 is located such that it will actuated by cam 46 to provide a true signal TS12U as car 12 ascends and enters the upper 12 inch zone 52. Switch 48 will maintain the true TS12U signal until car 12 descends and leaves the upper 12 inch zone 52. In like manner, switch 50 is located such that it will actuated to provide a true signal TS12L as car 12 descends and enters the lower 12 inch zone 54. Switch 50 will maintain the true TS12L signal until car 12 ascends and leaves the lower 12 inch zone 54.

TSD apparatus 40 includes a TSD limit function 56, a terminal zone detector function 58, a limiter function 60, a contract speed function 62, and a switch 64, such as an analog switch. A car controller 66 for car 12 may be the car controller shown in incorporated U.S. Pat. No. 3,750,850.

The TSD limit function 56 is responsive to all six of the hereinbefore described digital input signals, and it provides a pattern limit signal PTL for each incremental position of car 12 while it is in a TSD zone 43 or 45. TSD limit function 56 also provides a true signal TSU during the time car 12 is in the upper TSD zone 43, and a true signal TSL during the time car 12 is in the lower terminal zone 45.

The terminal zone detector function 58 is responsive to the signals TSU and TSL provided by TSD limit function 56, and also to the travel direction of car 12, as indicated by signals UPTR and DNTR provided by motor drive control 32. Motor drive control 32 obtains car direction signals from car controller 66. By obtaining travel direction from motor controller 32, TSD apparatus 40 maintains the required independence from car controller 66. Signal UPTR is true when car 12 is set for up travel and signal DNTR is true when car 12 is set for down travel. Terminal zone detector function 58 operates switch 64 when car 12 is in a terminal zone, and is set for travel towards the terminal floor associated with the terminal zone. Switch 64 is normally set to connect a fixed voltage CSL to limiter 60 having a magnitude indicative of the contract speed of elevator car 12. When terminal zone detector 58 determines that car 12 is in a terminal zone set for travel towards the terminal floor associated with the zone, it actuates switch 64 to connect the pattern limit PTL to limiter 60.

Limiter 60 receives a speed pattern SP from car controller 66, and either the contract speed limit CSL or the pattern limit PTL. Limiter selects the lower of the two signals applied thereto at any instant, such as the pattern limiter disclosed in the incorporated U.S. Pat. No. 4,161,235. Limiter 60 applies the lesser of the two active signals applied thereto to the motor drive control 32, which controls motor 30 according to the pattern received from limiter 60.

Figure 2A:
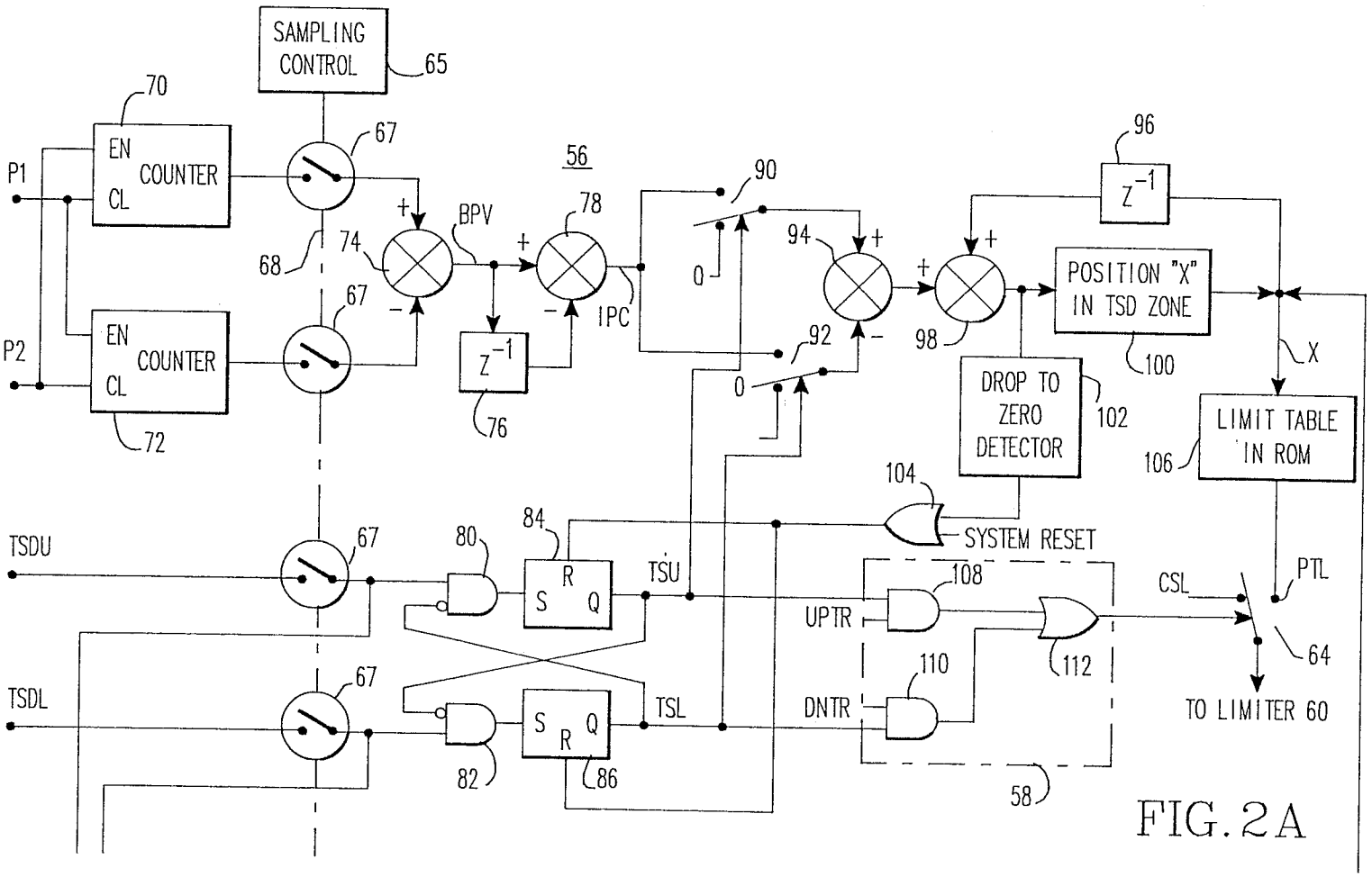
FIG. 2A and 2B are a detailed schematic diagram of a TSD limit circuit and a terminal zone detector circuit which may be used for those functions shown in block form in FIG. 1.
Figure 2B:
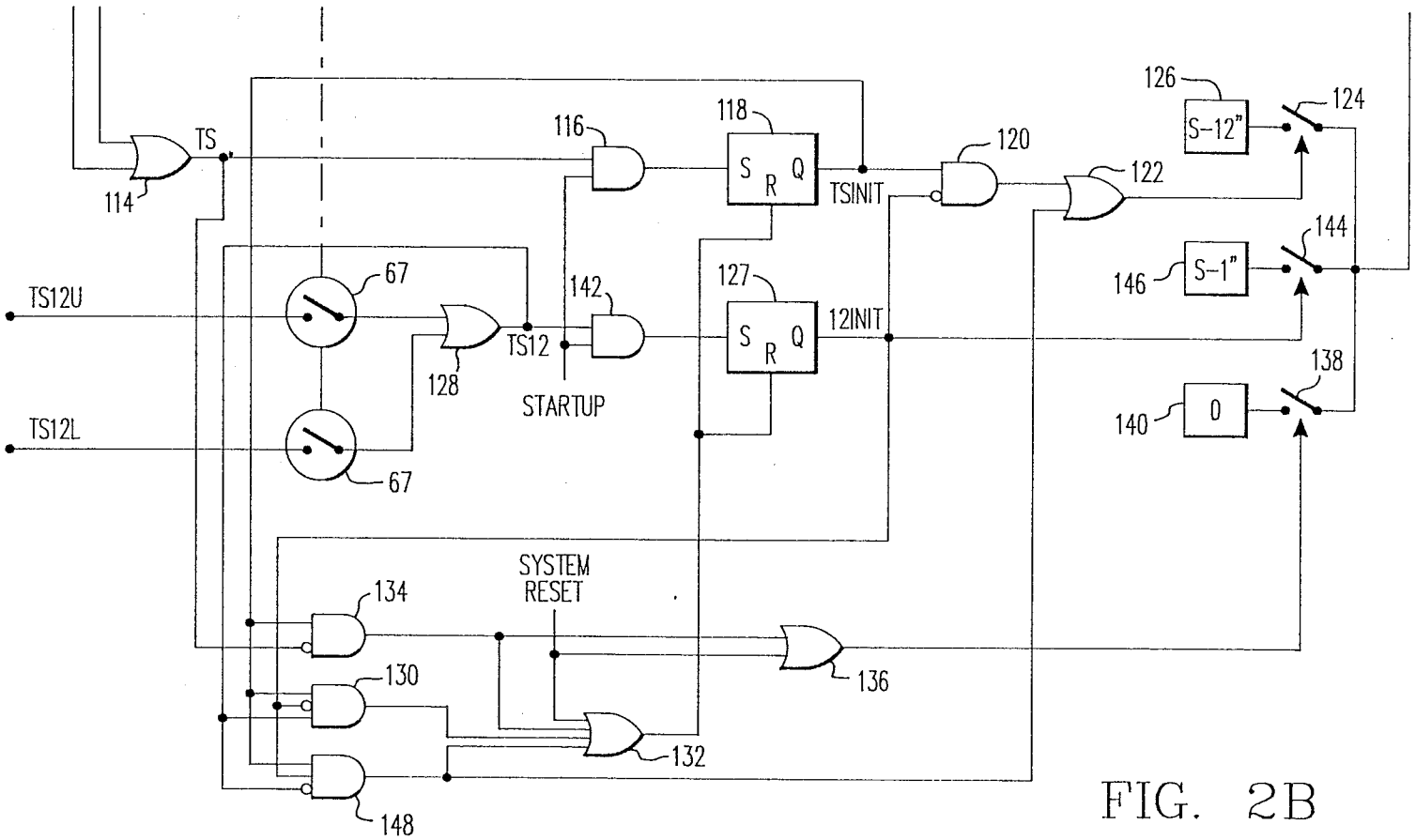

FIG. 2 is a detailed schematic diagram of the TSD limit function and the terminal zone detector function 58, implemented according to preferred embodiments of the invention. The TSD system 40 is intended for implementation in a discrete data environment, such as a digital computer, where input data is sampled in the course of an algorithm which is executed at regular intervals of time. The digital sampling function is indicated generally at 65. A vertical array of switches 67 shown connected by a broken line 68 in FIG. 2 functionally indicates the sampling of the binary input signals.

The two binary signals P1 and P2 provided by shaft encoder 34 are used to clock two binary counters 70 and 72, respectively, in such a way that each counter counts in only one direction of motor shaft rotation, and this direction is different for the two counters. As shown in FIG. 3A, with one shaft rotational direction signal P1 leads signal P2 by 90 degrees. Thus, signal P1 may be used as an enable signal for counting positive going transitions of signal P2 on counter 72. As shown in FIG. 3B, with the opposite motor shaft rotational direction, signal P2 leads signal P1 by 90 degrees, and thus signal P2 may be used as an enable signal for counting positive going transitions of signal P1 on counter 70.

The output counts of counters 70 and 72 are sampled and subtracted at a summing point 74 using the prescribed signs to obtain a binary position value BPV for motor shaft rotation. The new value of BPV is compared with the previous value provided by function block 76 at a summing point 78, using the prescribed signs, to determine the incremental position change IPC since the previous sample was taken.

Input signals TSDU and TSDL are sampled and used to latch either of the two signals or flags TSU or TSL, with a true signal indicating the elevator car 12 is within the associated TSD zone, as hereinbefore described. Signals TSU and TSL are provided by dual input AND gates 80 and 82, each cf which have one inverting input, and flip flops 84 and 86. Signals TSDU and TSDL are connected to the non-inverting inputs of AND gates 80 and 82, respectively, the outputs of AND gates 80 and 82 are connected to the set inputs S of flip flops 84 and 86, respectively, and the Q outputs of flip flops 84 and 86 are connected back to the inverting inputs of AND gates 82 and 80, respectively.

Depending upon the states of signals TSU and TSL, a position integral "x" is either incremented by IPC, decremented by IPC, or not changed. Signals TSU and TSL control analog switches 90 and 92, respectively, to select the proper sign for incrementing or decrementing at point 94, which then performs the incrementing or decrementing of the prior position integral, provided by function block 96, at summing point 98, to provide the latest position integral "x", as indicated at 100. The position integral "x" indicates the distance traveled by car 12 in a TSD zone, either zone 43 or zone 45. As car 12 enters a TSD zone, "x" starts at zero and its value then continues to indicate the position of car 12 within the zone, even if car 12 stops and reverses direction in the zone. If car 12 travels to the terminal floor associated with the zone, "x" will equal S, the length of the TSD zone. When car 12 leaves a TSD zone, the value of "x" will drop to zero. This drop to zero is detected by a detector function 102, which resets flip flops 84 and 86 via an OR gate 104, which also receives a system reset signal during initialization.

The car position integral "x" is used to address a look-up table 105 stored in a read-only memory 106. The look-up table 105 stored in memory 106, as shown in a ROM map of look-up table 105 in FIG. 4, contains a car speed limit as an output signal for each input value of "x". The speed limit values in FPS are pre-calculated and following formula:

$$\text{Speed Limit} = \sqrt{2A\,(S - x)}$$

While the use of a look-up table is referred, it would also be suitable to use "x" to calculate each new speed limit each time "x" changes, such as in an associated digital computer.

The speed limit output PTL from memory 106 is applied to one input of switch 64. As hereinbefore described, the other input to switch 64 receives a signal which represents the contract speed limit of car 12. The terminal zone detector function 58 which controls switch 64 includes two AND gates 108 and 110 and an OR gate 112. If car 12 is in the upper terminal zone 43, set for up travel, signals TSU and UPTR will be true and AND gate 108 will provide a true output for OR gate 112, which in turn actuates switch 64 to connect the pattern limit signal PTL to limiter 60. In like manner, if car 12 is in the lower terminal zone 45, set for down travel, signals TSL and DNTR will be true and AND gate 110 will provide a true output for OR gate 112, which in turn actuates switch 64 to connect the pattern limit signal PTL to limiter 60.

Initializing TSD system 40 while car 12 is parked outside of a TSD zone requires no extra control function. Initializing TSD system 40 while car 12 is parked within a TSD zone does require additional control, as the value of the position integral "x" will not be known. The TSD limit function 56 will automatically detect this condition and select a temporary value of "x" according to whether car 12 is within a 12 inch zone or outside a 12 inch zone.

It will first be assumed that car 12 is parked within the upper TSD zone 43, but it is below the 12 inch zone 52. Signal TSDU is applied to an OR gate 114 which provides a true signal TS for a dual input AND gate 116 which is also connected to receive a true start-up signal during initialization. When the start-up signal is received, the resulting true output of AND gate 116 is latched in a flip flop 118, which provides a true output signal TSINIT. Signal TSINIT is applied to the non-inverting input of a dual input AND gate 120 having one inverting input. The inverting input of AND gate 120 is connected to the output of a flip flop 127 which is set only when car 12 is within the 12 inch zone during initialization. Thus, the output of AND gate 120 will go true and close a switch 124 via an OR gate 122. Switch 124 is connected to a function 126 which provides a digital value equal to the position integral "x" when it is indicating that the car is 12 inches from the terminal floor. Switch 124 jams the position integral "x" to this 12 inch value. If car 12 starts towards the upper terminal floor 18, switch 64 will connect the speed limit for the 12 inch point to limiter 60, and car 12 will move at this low speed towards the terminal floor 18.

When car 12 reaches the 12 inch zone 52, signal TS12U will go true, and the output of an OR gate 128 will go true. The output of OR gate 128 is connected to a non-inverting input of a three input AND gate 130 which has one inverting input. The other non-inverting input of AND gate 130 is connected to receive signal TSINIT from flip flop 118, which will also be true. The inverting input of AND gate 130 is connected to receive the output of flip flop 128, which output will be low. Thus, the output of AND gate 130 Will go true when car 12 arrives at the 12 inch zone 52, and an OR gate 132, which receives the output of AND gate 130, resets flip flop 118. Switch 124 thus opens when car 12 is positioned according to the value currently held by the position integral "x", releasing "x" to follow the normal change in "x", as hereinbefore described.

If car 12 is started in a direction away from the upper terminal floor, switch 64 will connect the contract limit signal CSL to limiter 60, and car 12 can travel at any speed up to the contract limit. When car 12 leaves the upper terminal zone 43, the true output TS from OR gate 114 will drop to logic zero in response to signal TSDU going to logic zero, and this change is detected by a dual input AND gate 134 having one inverting input. The inverting input is connected to receive the output of OR gate 114, and the non-inverting input is connected to the output of flip flop 118 to receive signal TSINIT, which will still be true. Thus, the output of AND gate 134 will go true, and an OR gate 136 conveys this true output to a switch 138 which closes to jam the position integral "x" to a value of zero, stored in function block 140, indicating car 12 is not within a terminal zone. The output of AND gate 134 is also connected to an input of OR gate 132, which resets flip flop 118. When flip flop 118 resets, the output of AND gate 134 will go to zero, causing switch 138 to open.

When car 12 is initialized while it is within the upper 12 inch zone 52, signal TSDU will be true, and flip flop 118 will output a true signal TSINIT. However, signal TS12U will also be true, and it is applied to OR gate 128 which applies its output to a dual input AND gate 142 which receives a start-up signal during initialization. The output of AND gate 142 is applied to the set input S of flip flop 127, and the output of flip flop 127 provides a signal 12INIT, which as hereinbefore stated is connected to the inverting input of AND gate 120. Signal 12INIT also controls a switch 144 which, when closed, jams the position integral "x" to a value provided by a function 146 which defines a car position close enough to the terminal floor such that the look-up table in memory 106 will provide a creep or leveling speed. For example, function 146 may provide a digital signal which indicates a position 1 inch from the terminal floor. Thus, the true signal 12INIT blocks AND gate 120, and it closes switch 144 to jam "x" to the 1 inch position. If car 12 moves in a direction towards the upper terminal floor 18, it will move at creep or leveling speed.

If car 12 moves away from the terminal floor 18, switch 64 will select the contract speed CSL as the limit. As soon as car 12 leaves the upper 12 inch zone, the position integral "x" will be set to indicate a position of 12 inches, and normal operation will update "x" as it continues to move in the upper terminal zone 43. This is accomplished by a three input AND gate 148 which has one inverting input. The inverting input is connected to receive the output TS12 from OR gate 128. The remaining two inputs to AND gate 148 receive signals TSINIT and 12INIT from flip flops 118 and 127, respectively, which will both be at a logic one level. Thus, when signal TS12U goes low as car 12 leaves the 12 inch zone 52, the output of OR gate 128 will go low and switch the output of AND gate 148 high. The high output from AND gate 148 will close switch 124 to set "x" to signify a location of 12 inches from the upper terminal floor 18. The output of AND gate 148 is also connected to an input of OR gate 132, which in turn resets flip flops 118 and 127, causing the output of AND gate 148 to go low, opening switch 144 to release "x" after being set to indicate the 12 inch point, to allow "x" to follow normal updating.

Initializing the system 10 with car 12 parked in the lower terminal zone 45, either outside the 12 inch zone 54 or within the 12 inch zone 54, is similar to that just described relative to the upper terminal zone 43 and the upper 12 inch zone 52, except the procedure uses the remaining inputs to OR gates 114 and 128.

In summary, there has been disclosed a new and improved feedback controlled elevator system 10 having an independent control over terminal slowdown, which adds very little to the cost of the elevator system, especially when the motor servo control system 32 requires a high resolution digital position encoder 34 to be mounted on the traction motor shaft, as many modern elevator drives require.

I claim:

1. In a feedback controlled traction elevator system having an elevator car and counterweight positionally controlled in a hatch of a building by a traction sheave driven by a traction drive motor under the direction of feedback control which includes a speed pattern for controlling at least the slowdown speed of the elevator car, comprising:

first means establishing upper and lower terminal slowdown zones in the hatch adjacent to upper and lower terminal floors, respectively, of the building, second means translating angular rotation of the traction motor to distance "x" traveled by the elevator car into a terminal zone, third means providing a maximum car speed at predetermined values of "x", for stopping the elevator car at a terminal floor at a predetermined deceleration rate, and fourth means for limiting the speed pattern to the maximum car speed provided by the third means as the elevator car approaches a terminal floor in a terminal zone.

2. The elevator system of claim 1 including:

fifth means in the hatch establishing a discrete positional datum within each of the upper and lower terminal slowdown zones relative to the upper and lower terminal floors, and sixth means holding "x" to the discrete positional datum when the elevator car is initially started within a terminal slowdown zone between the start of the associated terminal zone and the positional datum, releasing "x" to respond to the second means when the elevator car crosses the positional datum and otherwise setting "x" to zero when the elevator car leaves the associated terminal zone without crossing the positional datum.

3. The elevator system of claim 2 wherein the sixth means holds "x" to a value close to the position of the associated terminal floor when the elevator car is initially started within a terminal zone between the positional datum and the associated terminal floor, setting "x" to the value of the positional datum in response to the elevator car crossing the positional datum, and then releasing "x" to respond to the second means.

4. The elevator system of claim 1 wherein the second means includes:

an encoder which provides first and second digital signals related in phase according to the rotational direction of the traction drive motor, first and second binary counters for counting the first and second digital signals, respectively, with the first binary counter counting the first binary signal only when the car is traveling towards a terminal floor in the associated terminal slowdown zone, and with the second binary counter counting the second binary signal only when the elevator car is traveling away from a terminal floor in the associated terminal zone.

5. The elevator system of claim 4 wherein the first digital signal provides a clock signal for the first counter and an enable signal for the second counter, and the second digital signal provides a clock signal for the second counter and an enable signal for the first counter, with the rotational direction of the traction drive motor determining which counter is enabled when clocking signals are provided.

6. The elevator system of claim 1 wherein the third means is a memory which stores pre-calculated values of speed limits for different values of "x", with said memory being accessed by each new value of "x" to determine the currently applicable speed limit for use by the fourth means.

7. The elevator system of claim 1 wherein the fourth means includes a first speed limit related to contract speed, a switch which is normally connected to limit the speed pattern to said first speed limit, and terminal zone detector means which operates the switch to be responsive to the third means when the elevator car is approaching a terminal floor within the associated terminal slowdown zone.

* * * * *